US008894160B1

(12) United States Patent
Christensen

(10) Patent No.: US 8,894,160 B1
(45) Date of Patent: Nov. 25, 2014

(54) MODULAR SEALED DISPLAY

(71) Applicant: Robert Christensen, Foster City, CA (US)

(72) Inventor: Robert Christensen, Foster City, CA (US)

(73) Assignee: Christy Vault Company, Inc., Colma, CA (US)

( * ) Notice: Subject to any disclaimer, the term of this patent is extended or adjusted under 35 U.S.C. 154(b) by 0 days.

(21) Appl. No.: 13/668,162

(22) Filed: Nov. 2, 2012

(51) Int. Cl.
*A47B 87/00* (2006.01)
*A47F 3/00* (2006.01)

(52) U.S. Cl.
USPC ..... 312/108; 312/138.1

(58) Field of Classification Search
CPC ..... A47B 87/0215; A47B 87/007; A47B 87/008; A47B 87/0284; A47B 87/0292
USPC ..... 312/107–111, 114, 138.1
See application file for complete search history.

(56) References Cited

U.S. PATENT DOCUMENTS

| | | | | | |
|---|---|---|---|---|---|
| 2,023,260 | A * | 12/1935 | Beers et al. | ..... | 312/114 |
| 3,316,041 | A * | 4/1967 | Nelson | ..... | 312/140 |
| 3,552,817 | A * | 1/1971 | Marolongo | ..... | 312/107 |
| 4,043,477 | A * | 8/1977 | Deese | ..... | 220/23.4 |
| 4,998,587 | A * | 3/1991 | Thomas | ..... | 169/51 |
| 5,271,515 | A * | 12/1993 | Berkheimer et al. | ..... | 220/4.27 |
| 5,350,057 | A * | 9/1994 | Bemis et al. | ..... | 220/4.01 |
| 5,470,139 | A * | 11/1995 | Hsiao | ..... | 312/140 |
| 5,775,046 | A * | 7/1998 | Fanger et al. | ..... | 52/590.1 |
| 5,924,778 | A * | 7/1999 | TenBrink | ..... | 312/114 |
| 6,735,831 | B1 * | 5/2004 | Greiwe et al. | ..... | 27/1 |
| 2004/0149754 | A1 * | 8/2004 | Diamant | ..... | 220/23.6 |
| 2008/0116772 | A1 * | 5/2008 | Champagne | ..... | 312/117 |
| 2009/0039742 | A1 * | 2/2009 | Ripley, Jr. | ..... | 312/114 |
| 2010/0127603 | A1 * | 5/2010 | Hahn | ..... | 312/117 |

* cited by examiner

*Primary Examiner* — Darnell Jayne
*Assistant Examiner* — Timothy M Ayres
(74) *Attorney, Agent, or Firm* — Carr & Ferrell LLP

(57) ABSTRACT

A modular display having a front panel, a plurality of side panels, a rear panel, a first engagement member and a second engagement member is disclosed. A plurality of modular displays may be joined together by juxtaposing or superposing the various first engagement members and second engagement members of the plurality of modular displays.

7 Claims, 9 Drawing Sheets

FIG. 9
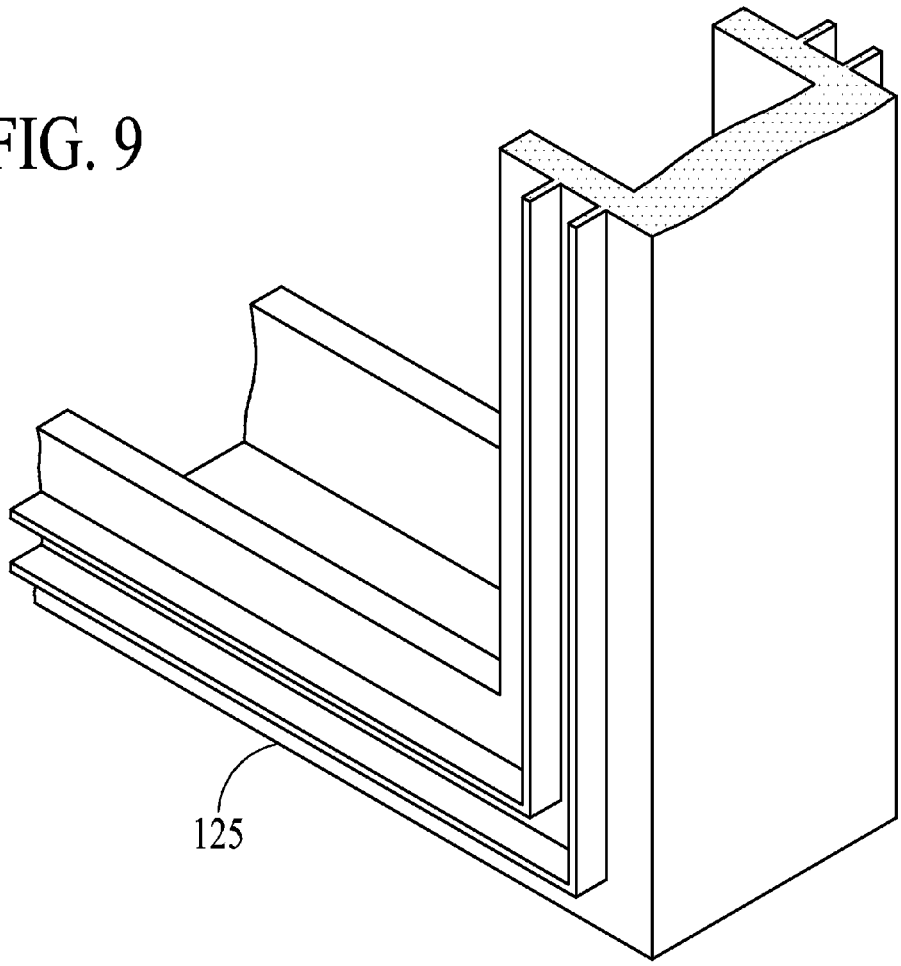
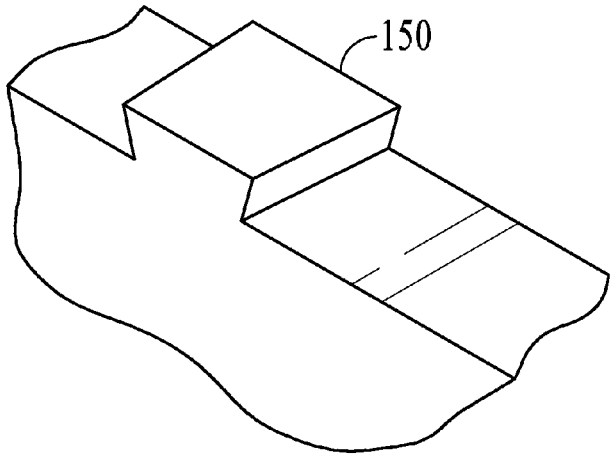
FIG. 10

MODULAR SEALED DISPLAY

BACKGROUND OF THE INVENTION

1. Field of the Invention

This present technology relates generally to sealed modular displays, and more specifically, but not by way of limitation, to sealed modular displays that can easily be combined and assembled with at least one other sealed modular display to form a strong and stable structure in a manner that is convenient and easy to assemble.

2. Background

Conventional displays, which are often used in mortuaries, schools, museums, homes and other similar places can store and display a number of different items, such as the cremated remains of a deceased and a photograph or a prized possession belonging to or relating to the deceased, a prized trophy or memorabilia, important documents (such as a diploma or certificate), artifacts or other similar items that need both protection and display. These conventional displays are often stacked on top of each other to minimize the space that they occupy. It can be frustrating, burdensome and tiresome to balance these conventional displays on top of each other. Further, without additional materials such as small scaffolding, securing anchors and binding agents, it can also prove dangerous, because there is the risk that the assembly of conventional displays can collapse, shift or otherwise fall apart. Furthermore, because the assembly of multiple conventional displays can be difficult and unstable, it is often the case that damage to the conventional display occurs during the assembly of one or more of the conventional displays. Thus, conventional displays may result in damage to the remains of the contents of the conventional display. Conventional displays have no means for making the assembly of a plurality of conventional displays easy and convenient.

SUMMARY OF THE INVENTION

Various embodiments of the invention comprise a modular display that includes a fluid modular engagement system that allows a plurality of modular displays to be assembled with one another easily and conveniently without the alteration of any of the plurality of modular displays, resulting in a stable formation larger than any modular display by itself. The fluid modular engagement system also allows for an assembly of a plurality of modular displays to be disassembled easily without the alteration of any one of the plurality of modular displays. When a plurality of modular displays are assembled, they may form a display wall that could be found in a mortuary, school, museum, home, or other similar places.

Embodiments of the invention include a plurality of side panels, at least one front panel made from glass or a material with glass-like properties, and at least one rear panel located in a position opposite the front panel. The plurality of side panels may be connected to each other at their side edges and form right angles with adjoining side boards, thus forming a square or rectangular shape, depending upon the relative size of each side board. The plurality of side panels along with the front and rear panels form a hollow interior space, where the remains of the deceased, along with a photograph of the deceased and/or various prized possessions, a prized trophy or memorabilia, important documents (such as a diploma or certificate), artifacts or other similar items that need both protection and display.

Various embodiments of the modular display also include at least one front engagement member and at least one rear engagement member, the at least one front engagement member adjacent to the front panel, and the at least one rear engagement adjacent to the rear panel, with the distance between the front and rear engagement members being approximately equal to the width of side panels. In some embodiments, the at least one front engagement member and the at least one rear engagement member are in the form of dovetail-shaped protrusions and dovetail-shaped grooves. These projections and grooves are designed to engage with one another when at least two or more modular displays are superposed or juxtaposed with one another. When engaged, the dovetail-shaped projections and grooves provide a strong and stable assembly. In this manner, a plurality of modular displays can be assembled together to form a stable structure in a convenient and easy to assemble manner. Additionally, the modular displays can be easily re-arranged in different combinations and can be easily replaced and/or maintained.

Embodiments of the invention also include at least one alignment bar that bridges the space between the front and rear engagement members. In some embodiments, the alignment bar is a spacer element that has a cross-sectional square or rectangular shape. The at least one alignment bar provides stability in the assembly and disassembly of a plurality of modular displays by allowing one modular display to be installed on top of another modular display through the at least one alignment bar on each modular display sliding along each other, thus allowing for easier assembly and disassembly.

Embodiments of the invention also include a display light that illuminates at least a portion of the hollow region that is defined by the plurality of side panels, the front panel, and the rear panel of the modular display. The display light illuminates the hollow region and can be remotely switched on and off.

BRIEF DESCRIPTION OF THE DRAWINGS

FIG. 9 shows an exploded view of an exemplary seal.

FIG. 10 shows an exploded view of an exemplary dovetail-shaped protrusion.

DETAILED DESCRIPTION OF THE DRAWINGS

Figure 1:
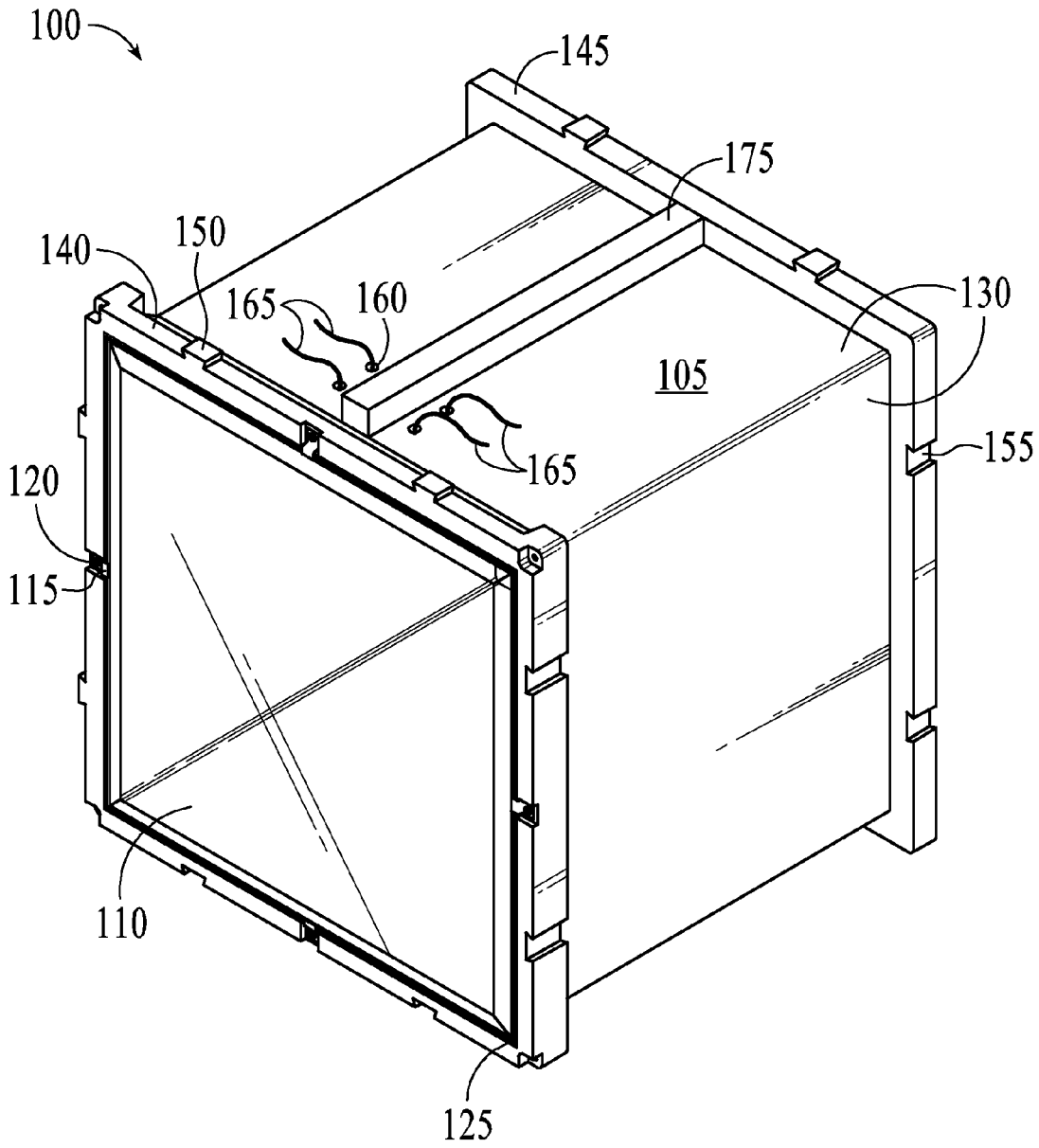
FIG. 1 shows a front perspective view of an exemplary embodiment.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Embodiments according to the present technology include a modular display including a fluid modular engagement system that allows a plurality of modular displays to be assembled with one another easily and conveniently without the alteration of any of the plurality of modular displays, resulting in a stable formation larger than any modular display by itself. The fluid modular engagement system also allows for an assembly of a plurality of modular displays to be disassembled easily without the alteration of any one of the plurality of modular displays. The modular display, when assembled with other modular displays, can form a larger display, or a display wall, that could be found in a mortuary, school, museum, home, or other similar places.

Various embodiments of the invention include a plurality of side panels as well as a front panel made from glass or a material with glass-like properties, and a rear panel opposite the front panel. The plurality of side panels are joined together at their side edges and can form right angles with respect to adjacent panels to ultimately form a square or rectangular shape. The plurality of the side panels and the rear panel are combined to form the display body. Further, the plurality of side panels along with the front and rear panels form a hollow interior space. Various embodiments of the unit also include one or more engagement members. In some embodiments, these engagement members are in the form of dove-tail shaped protrusions and dove-tail shaped grooves. These projections and grooves are meant to engage with one another in the event that two modular displays are superposed or juxtaposed with one another. When engaged, the dovetail-shaped projections and grooves provide a strong and stable assembly. In this manner, a plurality of modular displays can be assembled together to form a stable body of a plurality of modular displays in a convenient and easy to assemble manner. Additionally, the displays are easily re-arranged in different combinations, and can be easily replaced and/or maintained during the use of the modular display.

In various embodiments of the invention, the display body is composed of polymers, metals, ceramics or composites thereof. In some embodiments, the display body is made from a polymer, such as Bulk Molding Compound (BMC).

Referring now to the drawings, and more particularly to FIG. 1, which illustrates an exemplary modular display 100 from a front perspective. The modular display 100 is shown as generally comprising a modular display body 105, a front panel 110 that may be attached to the modular display body 105 with one or more clips 115. The one or more clips 115 may be secured to the modular display body 105 through the use of one or more screws 120 or other similar fasteners. According to various embodiments, the front panel 110 may additionally form an air-tight seal with the modular display body 105 through the use of a seal 125 (an exploded view of which can be found in FIG. 9) positioned around the perimeter of the front panel 110 and pressed against the modular display body 105. The seal 125 may be composed of silicon, rubber, or other similar materials. In some embodiments, the seal 125 is made from a material such as molded silicon.

According to some embodiments, the modular display body 105 may be composed of one or more side panels 130, a rear panel 205 (see FIG. 2), a first engagement member 140 and a second engagement member 145, the first engagement member 140 and the second engagement member 145 both containing a plurality of dovetail-shaped projections 150 (an exploded view of which can be found in FIG. 10) and dovetail-shaped grooves 155.

Figure 8:
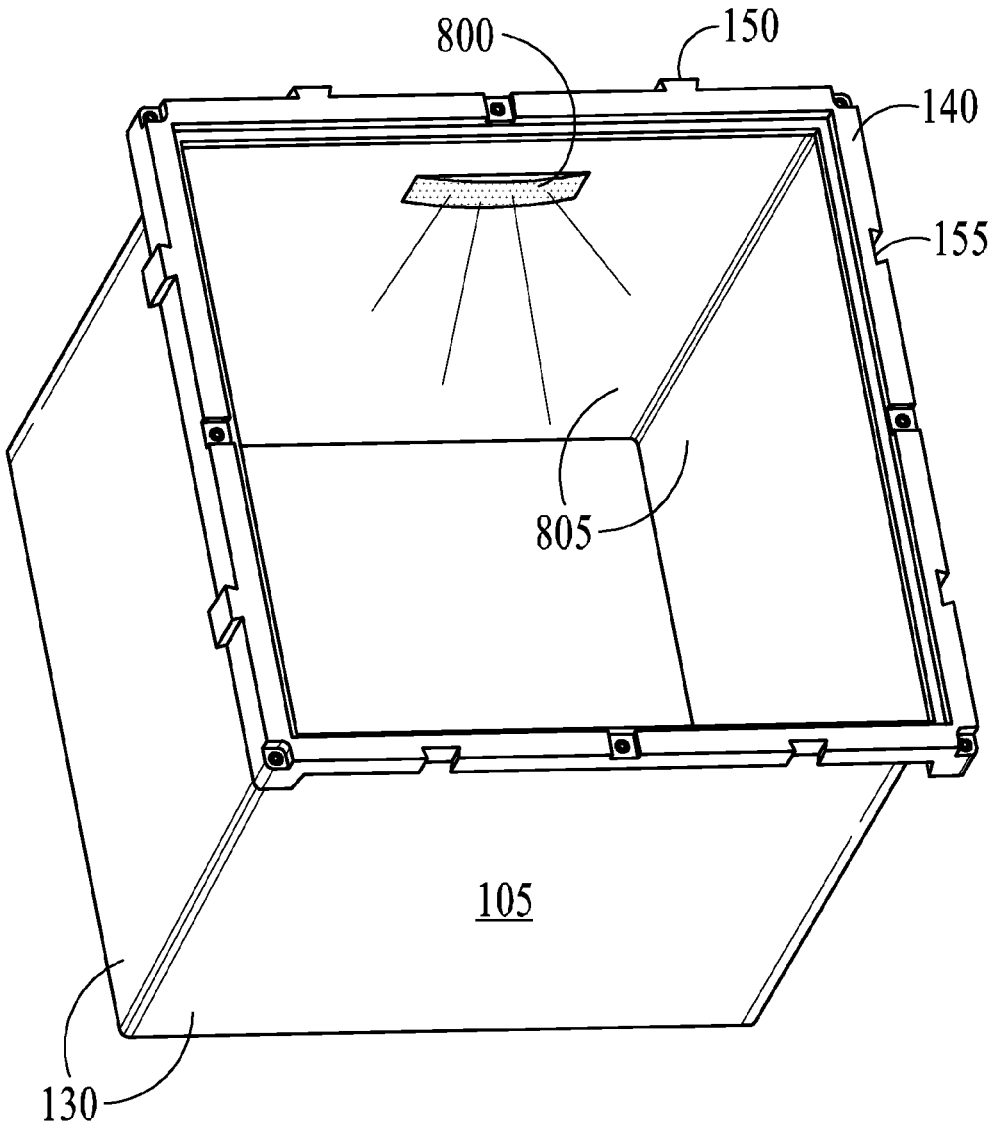
FIG. 8 shows a front perspective view from a lower perspective of an exemplary embodiment.

In various embodiments, the modular display body 105 also includes a number of holes 160 through which an electrical cords 165 may pass in order to supply power to a light 805 (see FIG. 8). The light 805 is intended to illuminate the interior hollow space formed by the modular display body 105 and the front panel 110. After passing through the holes 160 in the modular display body 105, the electrical cords 165 may be wired in series or parallel with other electrical cords from other modular displays 100.

In certain other embodiments of the invention, the modular display 100 may also comprise one or more alignment rails 175 that are removably attached to the top and bottom panels of the modular display body 105. These alignment rails 175 function as rails that allow one modular display 100 to slide along the top of another modular display 100 during the assembly of at least two modular displays in a vertical manner. The alignment rails 175 on the respective top panel of the lower modular display 100 and bottom panel of the upper modular display 100 slide along each other, allowing the upper modular display 100 to slide along the lower modular display 100 into full engagement position easily.

Figure 2:
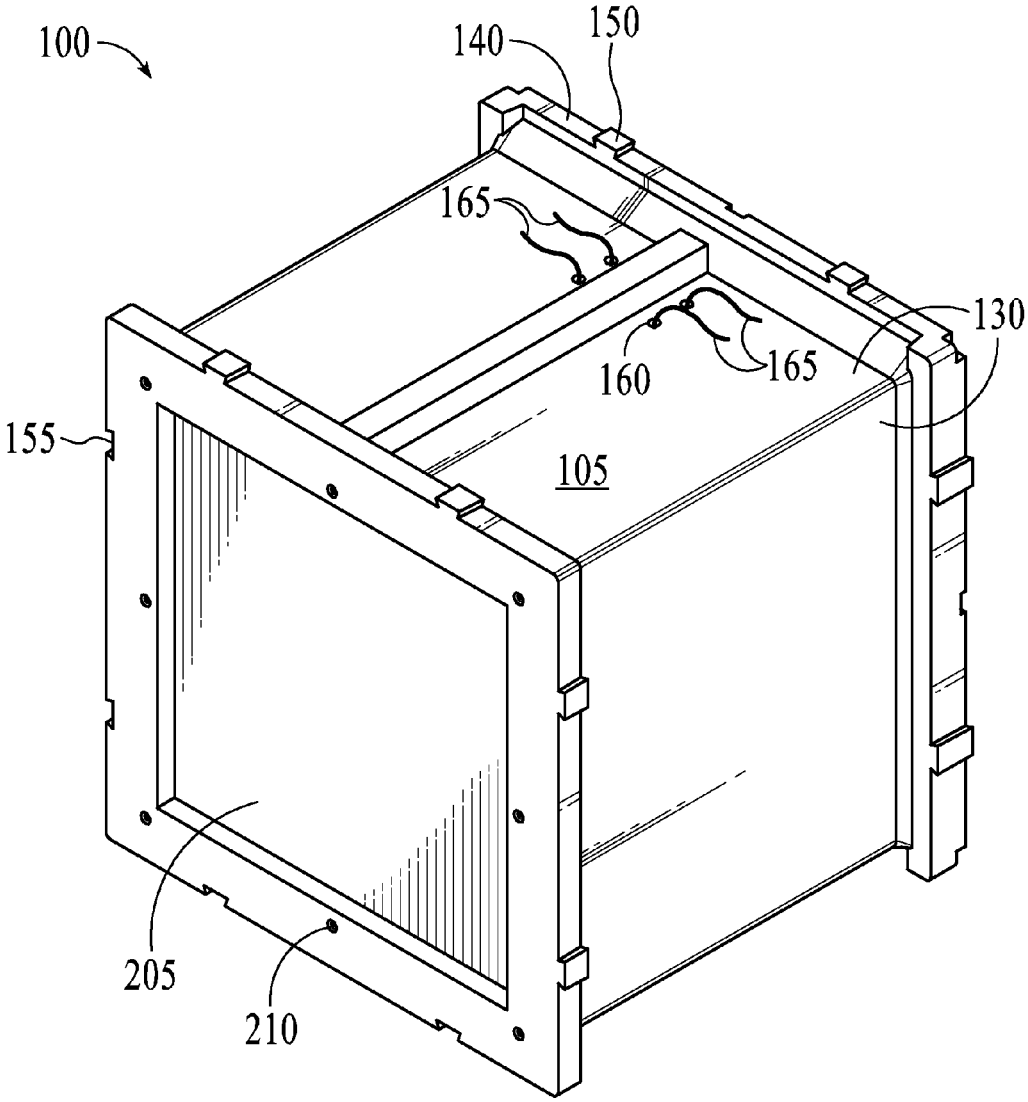
FIG. 2 shows a rear perspective view of an exemplary embodiment.

Referring now to FIG. 2, an exemplary modular display 100 from a rear perspective is shown. According to various embodiments of the invention, the second engagement member 145 may be removably attached to the rear panel 205 through the use of one or more fasteners 210.

Figure 3:
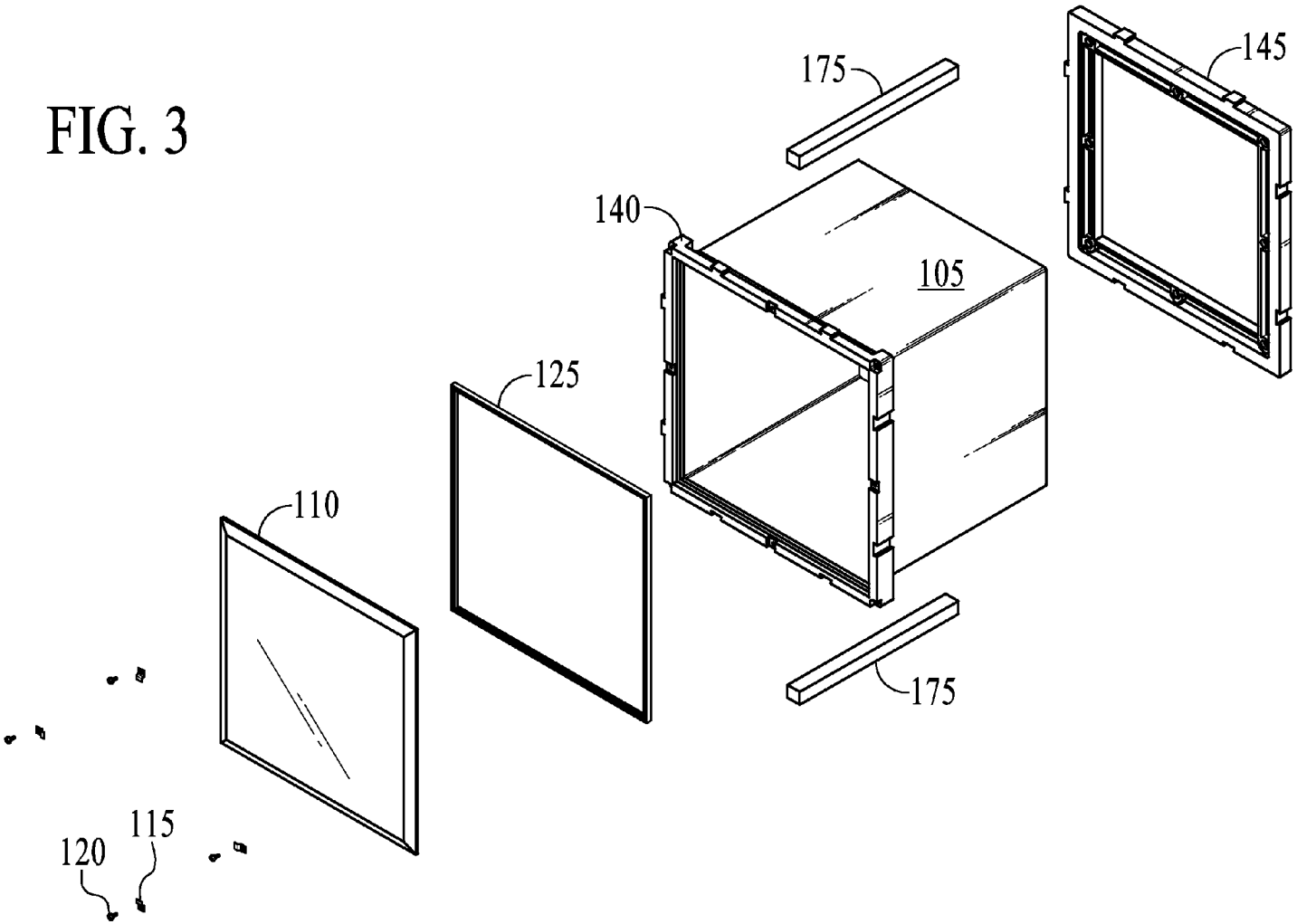
FIG. 3 shows an exploded front perspective view of an exemplary embodiment.

FIG. 3 illustrates an exemplary modular display 100 from a front exploded view. In various embodiments, the screws 120 pass through one side of the clips 115 and are threaded into the modular display body 105. Positioned between the clips 115 and the modular display body 105 are the front panel 110 and the seal 125. When the screws are tightened into the modular display body 105, the clips press in on the front panel 110 and the seal 125 to hold them in position and create a substantially air-tight seal between the front panel 110 and the modular display body 105 through the use of the seal 125.

In some embodiments, the second engagement member 145 is removably attached. As shown in FIG. 3, the second engagement member 145 is separate from the modular display body 105.

Figure 4:
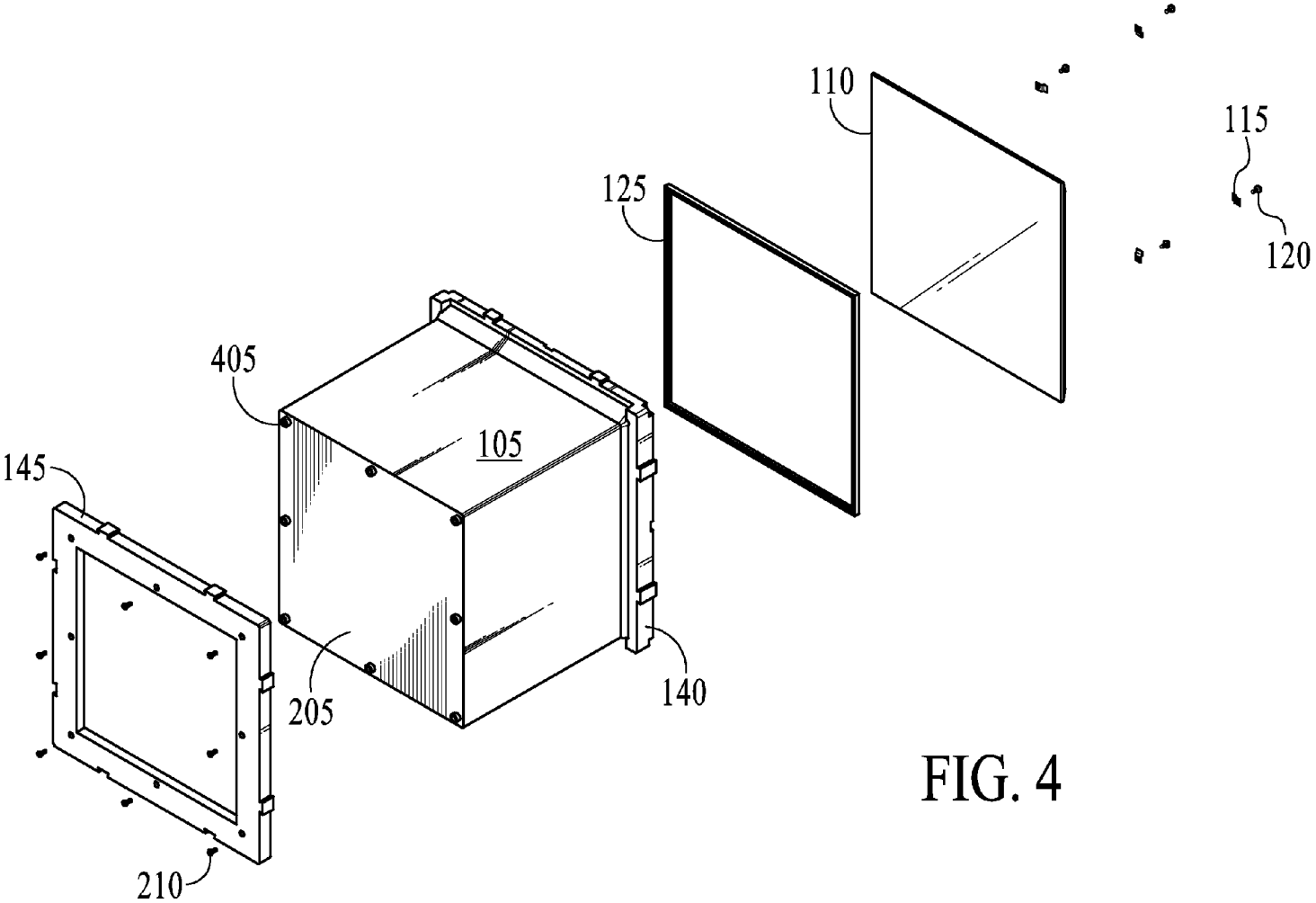
FIG. 4 shows an exploded rear perspective view of an exemplary embodiment.

Referring now to FIG. 4, an exemplary modular display 100 from a rear exploded view is shown. In various embodiments, the second engagement member 145 is removably attached to the rear panel 205 of the modular display body 105 through the use of fasteners 210 and friction fasteners 405. In some embodiments, the friction fasteners 405 are cylindrical protrusions extending outwardly from the rear panel 205 and are configured to fit into correspondingly-shaped holes within the front face of the second engagement member 145.

Figure 5:
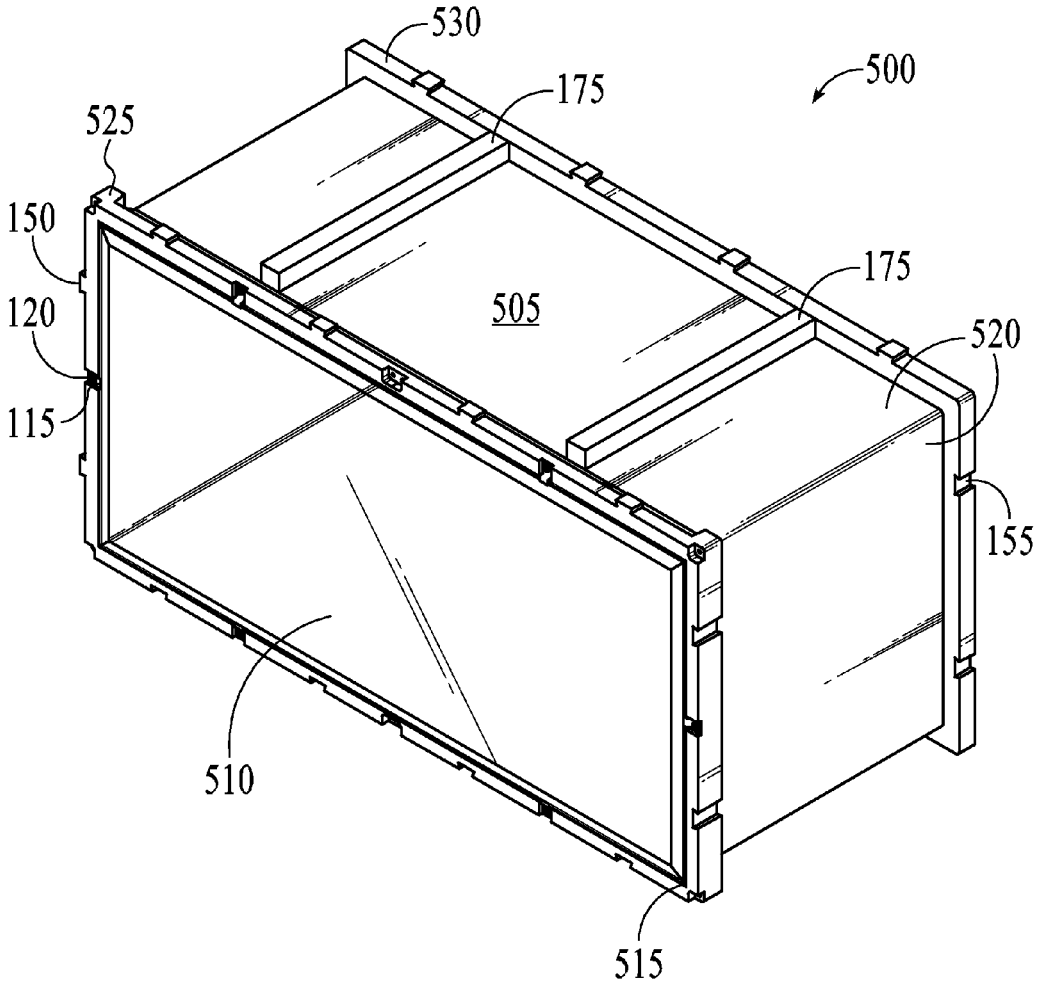
FIG. 5 shows a front perspective view of an exemplary embodiment.

FIG. 5 illustrates an alternative embodiment of a wide modular display 500 from a front perspective. The wide modular display 500 is shown as generally comprising a wide modular display body 505 and a wide front panel 510. The wide modular display body 505 is wider than the modular display body 105. Correspondingly, the wide front panel 510 is wider than the front panel 110. The wide front panel 510 is held onto the wide modular display body 505 with one or more clips 115. In certain embodiments, the width of the wide modular display 500 is approximately twice the width of the modular display 100, but still retains approximately the same depth and height as the modular display 100. The one or more clips 115 may be secured to the wide modular display body 505 through the use of one or more screws 120 or other similar fasteners. According to various embodiments, the wide front panel 510 may form a substantially air-tight seal with wide modular display body 505 through the use of a wide seal 515 positioned around the perimeter of the wide front panel 510 and pressed against the wide modular display body 505. The wide seal 515 may be composed of silicon, rubber, or other similar materials. In some embodiments, the wide seal 515 is made from a material such as molded silicon.

According to some embodiments, the wide modular display body 505 may be composed of one or more side panels 520, a rear panel (not shown), a wide first engagement member 525 and a wide second engagement member 530, the wide first and second engagement members both containing a plurality of dovetail-shaped projections 150 and dovetail shaped grooves 155.

In certain other embodiments of the invention, the wide modular display 500 may also comprise one or more alignment rails 175 that are removably attached to the top and bottom panels of the wide modular display body 505. These alignment rails 175 function as rails that allow one wide modular display 500 to slide along the top of another wide modular display 500 during the assembly of at least two wide modular displays in a vertical manner. The alignment rails 175 on the respective top panel of the lower wide modular display 500 and bottom panel of the upper wide modular display 500 slide along each other, allowing the upper wide modular display 500 to slide along the lower wide modular display 500 into full engagement position.

Figure 6:
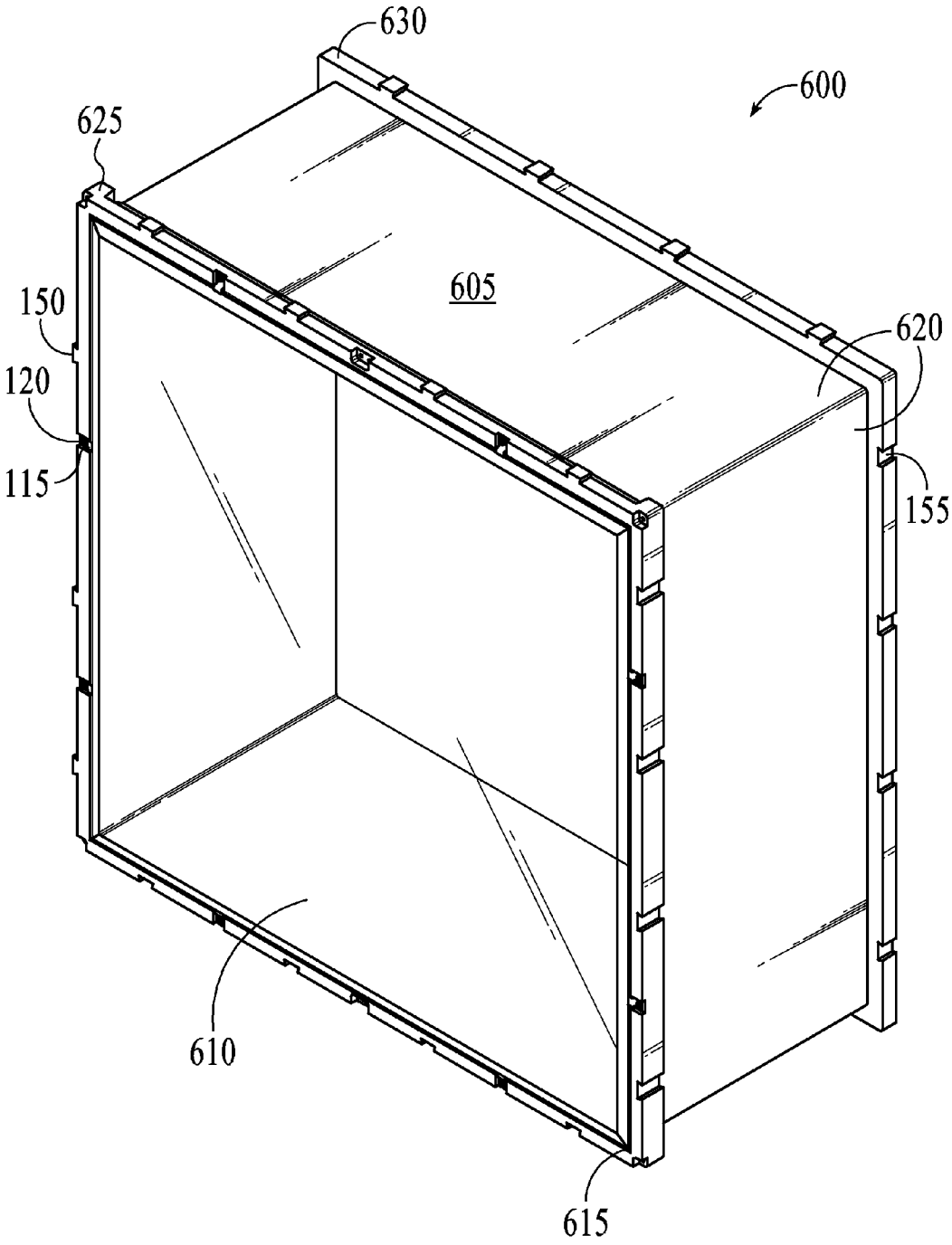
FIG. 6 shows a front perspective view of an exemplary embodiment.
Figure 7:
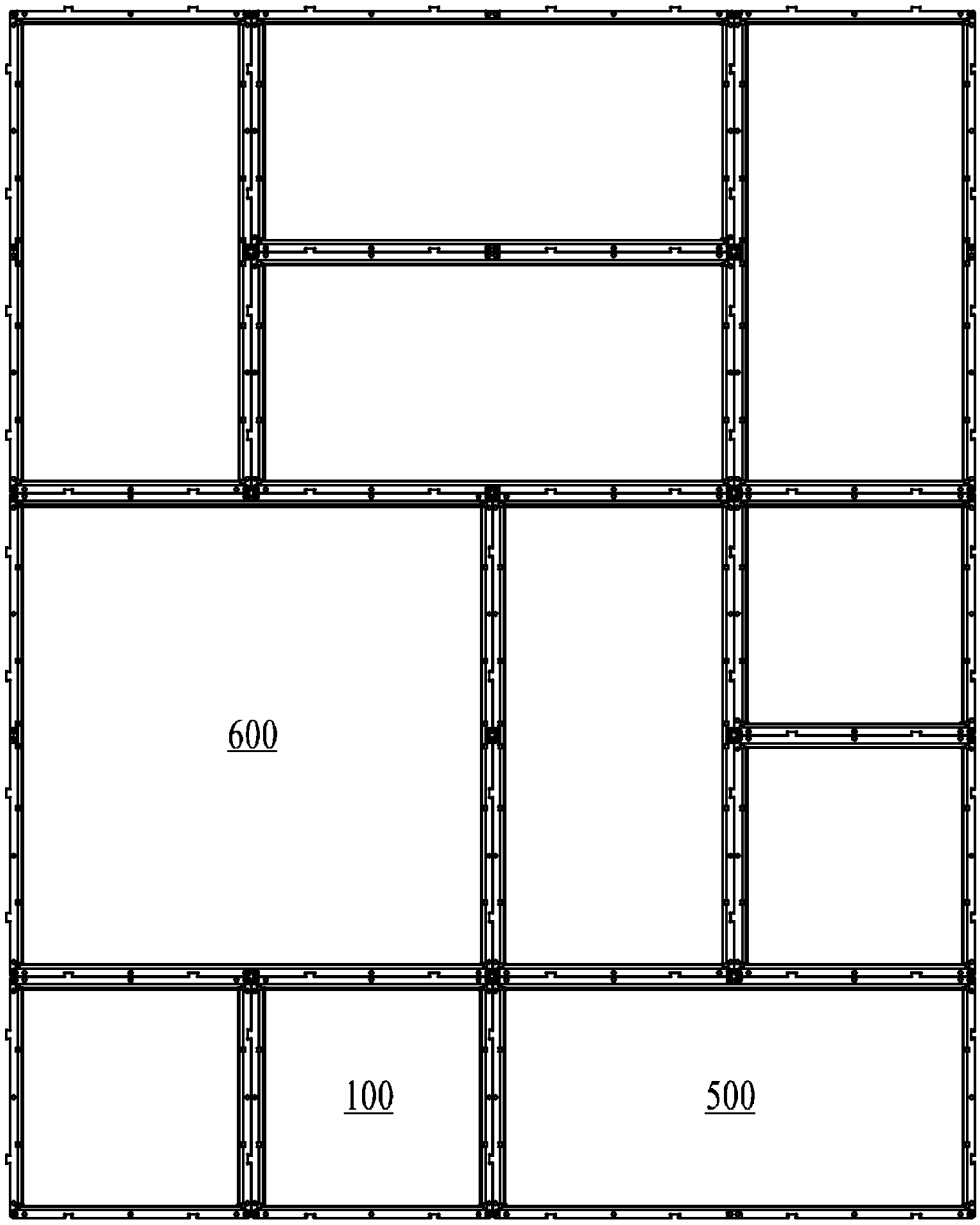
FIG. 7 illustrates a front view of an exemplary set of connected exemplary embodiments.

Referring now to FIG. 6, an alternative embodiment of a large modular display 600 from a front perspective is shown. The large modular display 600 is shown as generally comprising a large modular display body 605 that is larger in both width and height than the modular display body 105, a large front panel 610, that is larger in both width and height than the front panel 110. The large front panel 610 may be attached to the large modular display body 605 with one or more clips 115. In certain embodiments, the width and height of the large modular display 600 is approximately twice the width and height, respectively, of the modular display 100, but still retains approximately the same depth of the modular display 100. The one or more clips 115 may be secured to the large modular display body 605 through the use of one or more screws 120 or other similar fasteners. According to various embodiments, the large front panel 610 may form a substantially air-tight seal with large modular display body 605 through the use of a large seal 615 positioned around the perimeter of the large front panel 610 and pressed against the large modular display body 605. The large seal 615 may be composed of silicon, rubber, or other similar materials. In some embodiments, the large seal 615 is made from a material such as molded silicon.

According to some embodiments, the large modular display body 605 may be composed of one or more side panels 620, a rear panel (not shown), a large first engagement member 625 and a large second engagement member 630, the large first and second engagement members both containing a plurality of dovetail-shaped projections 150 and dovetail shaped grooves 155.

In certain other embodiments of the invention, the large modular display 600 may also comprise one or more alignment rails 175 that are removably attached to the top and bottom panels of the large modular display body 605. These alignment rails 175 function as rails that allow one large modular display 600 to slide along the top of another large modular display 600 during the assembly of at least two large modular displays in a vertical manner. The alignment rails 175 on the respective top panel of the lower large modular display 600 and bottom panel of the upper large modular display 600 slide along each other, allowing the upper large modular display 600 to slide along the lower large modular display 600 into full engagement position.

In assembling two or more modular displays, referring to FIGS. 7, 1, 5 and 6, two or more modular displays 100, 500 or 600 are juxtaposed or superposed with one another and the dovetail-shaped projections 150 of a first modular display are engaged with the dovetail-shaped grooves 155 of a second modular display. In one method of assembly, the two or more modular displays are assembled in a vertical fashion, with one modular display occupying a "top" position, and the other modular display occupying a "bottom" position. The modular display that is in the top position is aligned so that its dovetail-shaped grooves 155 line up with the dovetail-shaped projections 150 of the modular display that is in the bottom position. The modular display in the top position is pushed towards the rear of the modular display in the bottom position. During this push, the one or more alignment rails 175 on the modular display in the top position slide along the one or more alignment rails 175 on the modular display in the bottom position. The assembly of the two or more modular displays is completed when the first engagement member and second engagement member of the modular display in the top position are fully engaged with the complementary first engagement member and second engagement member of the modular display in the bottom position.

In an alternative assembly of two or more modular displays 100, 500 or 600, referring to FIGS. 7, 1, 5 and 6, the two or more modular displays are juxtaposed or superposed with one another and the dovetail-shaped projections 150 of a first modular display are engaged with the dovetail-shaped grooves 155 of a second modular display. In one method of assembly, the two or more modular displays are assembled in a horizontal fashion, with one modular display occupying a "left" position, and the other modular display occupying a "right" position. The modular display that is in the left position is aligned so that its dovetail-shaped grooves 155-line up with the dovetail-shaped projections 150 of the modular display that is in the right position. The modular display that is in the left position is pushed towards the rear of the modular display in the right position. The assembly of the two or more modular displays is completed when the first engagement member and second engagement member of the modular display in the left position are fully engaged with the complementary first engagement member and second engagement member of the modular display in the right position.

In the manners set forth above, or in matters similar to that stated, two or more separate modular displays can be combined in an easy-to-assemble manner. This manner of assembly may be used to make a larger structure of interconnected modular displays of the same or varying sizes to fill a desired area, including wall space.

FIG. 8 illustrates an exemplary embodiment of the invention from a front perspective view as seen from a lower perspective. The modular display body 105 can be internally illuminated from a light source 800 that is connected to the electrical cord 165 (see FIG. 1). In some embodiments, the light source 800 is comprised of an incandescent bulb with an optical amplification or focusing lens interposed between the incandescent bulb and the interior of the modular display body 105. Alternatively, the light source 800 may be comprised of light emitting diodes (LEDs), long-life compact fluorescent lights, halogen bulbs or other similar light-emitting devices.

In an alternative embodiment, referring now to FIG. 8, the interior walls 805 of the modular display body 105 may also have reflective qualities that would enable the light source

800 to be operated at a lower power level, thus increasing the efficiency of illuminating the interior of the modular display 100.

Several embodiments are specifically illustrated and/or described herein. However, it will be appreciated that modifications and variations are covered by the above teachings and within the scope of the appended claims without departing from the spirit and intended scope thereof. While examples discussed herein are in the context of a four sided modular display, it is contemplated that some embodiments may have more or less than four dies.

The embodiments discussed herein are illustrative of the present invention. As these embodiments of the present invention are described with reference to illustrations, various modifications or adaptations of the methods and/or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A modular display comprising:

a front panel;

a display body having a rear panel opposite the front panel, and side panels adjacent to the front and rear panels, wherein the front panel is secured to the side panels with at least one fastener and at least one clip;

a contiguous, one-piece first engagement member disposed substantially adjacent to the perimeter of the front panel, the first engagement member comprising four external sides, the four external sides each having at least one of a first engagement member dovetail-shaped projection and at least one of a first engagement dovetail-shaped groove; and a contiguous, one-piece second engagement member disposed substantially adjacent to the perimeter of the rear panel, the second engagement member comprising four external sides, the four external sides each having at least one of a second engagement member dovetail-shaped projection and at least one of a second engagement dovetail-shaped groove;

wherein the first and second engagement members removably attach the modular display to another modular display having complementary engagement members.

2. The modular display of claim 1, wherein the first and second engagement members comprise dovetail-shaped projections or dovetail-shaped grooves.

3. The modular display of claim 1, wherein the front panel is composed of glass, or another substantially transparent material.

4. The modular display of claim 1, wherein the front panel is secured to the side panels to form a substantially air-tight seal.

5. The modular display of claim 1 further comprising a light source designed to substantially illuminate at least a portion of the interior of the display.

6. The modular display of claim 1 further comprising at least one alignment rail.

7. The modular display of claim 1 further comprising at least one seal.

* * * * *